United States Patent [19]

Lefrant

[11] Patent Number: 4,821,911

[45] Date of Patent: Apr. 18, 1989

[54] CLOSING COVER FOR A METAL CONTAINER

[75] Inventor: Roger O. Lefrant, Casteau, Belgium

[73] Assignee: Manufacture de Bidons et Boites Metalliques M. Kouperman S.A., Brussels, Belgium

[21] Appl. No.: 92,098

[22] Filed: Sep. 2, 1987

[30] Foreign Application Priority Data

Sep. 2, 1986 [BE] Belgium ..... 0/217.110

[51] Int. Cl.[4] ..... B65D 3/00

[52] U.S. Cl. ..... 220/67; 220/310; 220/355

[58] Field of Search ..... 220/66, 67, 75, 81 R, 220/310, 354, 355, 358, 378

[56] References Cited

U.S. PATENT DOCUMENTS

| | | | |
|---|---|---|---|
| 1,189,294 | 7/1916 | Ruggles | 220/310 |
| 1,904,091 | 4/1933 | Shoop | 220/355 |
| 2,078,530 | 4/1937 | Courtright et al. | 220/75 X |
| 2,234,485 | 3/1941 | Connor | 220/355 |
| 3,295,485 | 1/1967 | Gedde | 220/67 X |
| 3,443,735 | 5/1969 | Meijers | 220/378 X |
| 4,220,254 | 9/1980 | Morton . | |
| 4,285,188 | 8/1981 | Morton . | |
| 4,376,506 | 3/1983 | Westphal | 220/81 R X |
| 4,386,715 | 6/1983 | Morton . | |
| 4,442,952 | 4/1984 | Patarini . | |
| 4,530,442 | 7/1985 | Vogel, Jr. et al. . | |

FOREIGN PATENT DOCUMENTS

| | | |
|---|---|---|
| 0002337 | 6/1979 | European Pat. Off. . |
| 687540 | 1/1940 | Fed. Rep. of Germany . |

*Primary Examiner*—Steven M. Pollard
*Attorney, Agent, or Firm*—Sughrue, Mion, Zinn, Macpeak & Seas

[57] ABSTRACT

An airtight closing cover is produced which can be reused many times, is not deformable, is corrosion-resistant and is easily accessible to the point of a screwdriver, by covering a metal ring 7 with a sheath 15 in a resilient synthetic material and a peripheral shoulder 16 which, in the closed position, is crushed by the cover (9) against a folded back rim (13) of the ring (7) and therefore comprises a barrier to possible corrosive vapors. (FIG. 1).

5 Claims, 2 Drawing Sheets

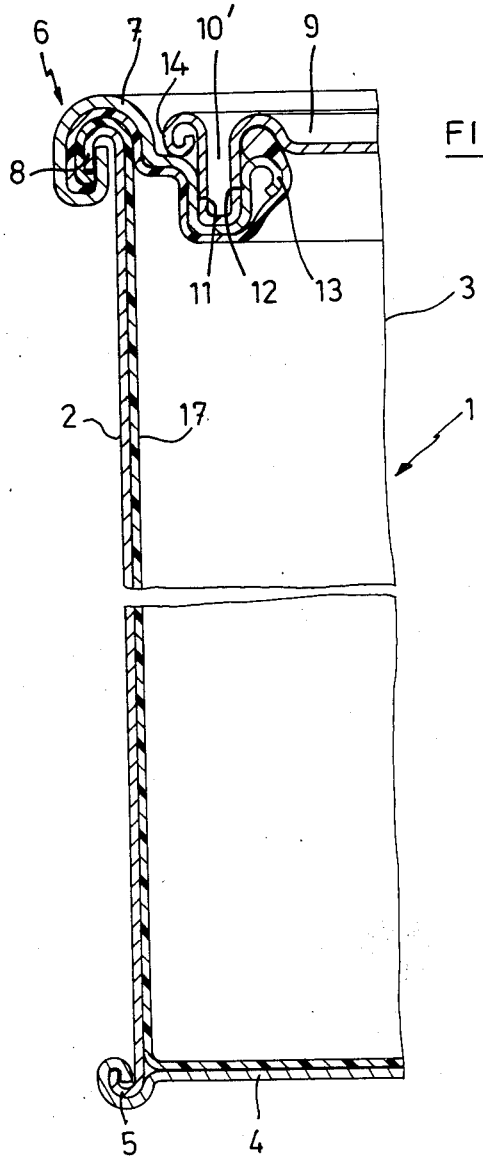
FIG. 2
FIG. 4
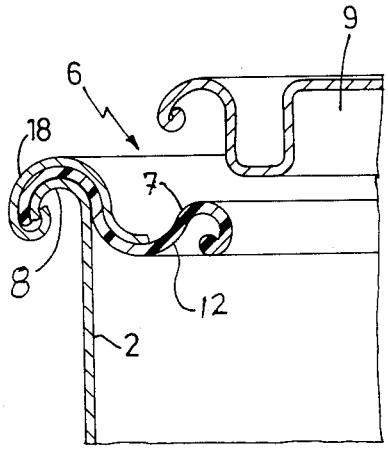

CLOSING COVER FOR A METAL CONTAINER

BACKGROUND OF THE INVENTION

The present invention relates to a closing cover for a metal container composed of a body having a substantially cylindrical or other shape, of a closing base crimped onto the lower edge of said body, comprising an interior ring crimped onto the upper edge of the body, with the free side of the ring being shaped so as to have a circumferential groove whose interior wing is reinforced by an rim which is folded back internally or externally in its extension, and a round cover whose marginal part has a convex angular profile with a complementary shape to that of said groove, so as to be held under pressure, and a peripheral reinforcing rim.

Its principal application is in paint and varnish shops as a packing element for pain products containing ingredients which are likely to attack the tin plate at places which are weakened through stamping.

The use for packing and shipping paint products of metal containers provided with a closing cover has been widespread for many years.

The metal containers are generally composed of a metal body having any shape whatever and of a round base crimped onto the lower edge of said body, so a to form the base of said metal container.

The closing cover comprises a metal ring which is stamped to have a profile with a groove and crimped onto the upper edge of the body of said container and a round cover whose marginal part has a circumferential rib which is intended to fit into said groove and provide a sealed metal-to-metal contact on the sides of the groove.

The object of the presence of metal ring is also to reinforce the crush resistance. It provides the closing cover with sufficient rigidity to allow the stacking of many metal containers on top of one another to enable, for example, their being handled on a palette.

In addition, the cover enables the introduction of a screwdriver head between the reinforcing flange and the crimped edge of the ring in order to carry out the removal of the cover without damaging or deforming said cover.

The ring and the cover are profiled such that the peripheral flange of the cover is flush with the crimped edge of the ring in the closed position of the container.

In order to reinforce the rigidity of the ring and improve the degree of sealing and the viability of the closing cover, it is provided to extend the interior wing of the groove of the ring with an interior or exterior folded-back edge coil.

The pressing down of the interior or exterior coil of the metal ring by stamping subjects said coil to extremely severe solicitations. Consequently, crackles are noted in the tin plate sheet which are due to the drawing of the sheets in stamping presses. As these are sheets which are possibly coated with a layer of varnish, it is not surprising to note that, at certain critical points of the folded back edge, the metal ring lacks protection and is directly submitted to the corrosive action of air, water and the solvents contained in the paint, varnish or other liquid or solid compositions packed in said metal containers.

It has therefore been observed that in the known metal containers, with American or triple-tight closures, a risk of rust along the folded back edge occurs during prolonged periods of stocking.

In the metal containers with an interior coil, that is comprising an interior ring whose rim is folded back towards the interior of the container, the annular fold of the free edge of the groove has a circumferential interstice which is in contact with the interior volume of the container, even in the presence of the cover. The formation of rust inevitably causes the contamination of the paint product contained in said container.

In the case of an externally coiled rim composed of a fold towards the interior of the groove, the rust which starts to form from the cutting edge, which is crackled, of the folded back rim extends progressively along the rim to form an annular mass of rust against the contact line of the cover and the interior ring. When the cover is removed, the contents of the metal container are inevitably contaminated.

To overcome this German patent DE-PS No. 687.540 describes a closure for tin plate containers cover internally with a protective film which is held in place by an annular metal closure ring crimped onto the upper edge of the body of the container.

The sealing of the closure is improved by providing an annular joint in the peripheral fold of the cover.

The manufacture of a container provided with such a closure is difficult, due to the fact that the crimping of the annular metal closure ring onto the body of the container and the fixing of the protective film on the coiled end of the ring are relatively laborious.

European patent application No. EP 0002337 also describes a container with a closing cover in which the cover is provided with a groove into which the body of another container can fit, so as to enable stacking and to facilitate packing during stocking and shipping.

The upper rim of the body of the container is provided with a closing annular ring made either of metal or of a resiliently deformable synthetic material. Such a container is, however, subject to corrosion when the metal closing ring is not protected with a protective sheath or has too low shock resistance when the ring consists simply of an annular profile in a synthetic material.

The problem posed consists of fixing, through crimping, a closing ring, which is not subject to corrosion, to the upper rim of the body of a metal container.

SUMMARY OF THE INVENTION

The present invention also seeks to protect from corrosion the folded back sides of a tin plate metal closing ring which is possibly protected by varnish. Such a ring is intended to receive the metal or synthetic material cover which closes the metal container. It also aims to provide an air-tight closure of a container closed by a cover which must in turn, be able to be placed in the groove of the closing ring and be removed a great number of times, without being damaged and without becoming prematurely detached under the action of interior pressure, for example the vapor tension of the solvent, or under the action of a shock.

As characterized in the following claims, the new element used in the closing cover in accordance with the invention is a preformed sheath of a resilient synthetic material which is ratched onto the interior surface of the interior ring and provided internally with a peripheral shoulder surrounding the aforementioned folded back rim. This sheath is fixed at its exterior periphery by crimping with the metal ring onto the upper edge of the body of the metal container.

The metal ring is covered with an annular sheath of a synthetic material provided with a peripheral shoulder, by ratching the sheath onto the interior surface of the ring. During the ratching, the peripheral shoulder of the sheath is folded over the folded back rim of the ring and with said ring forms an assembly which is then crimped onto the upper rim of the body of the metal container.

The resulting resilient annular point is fixed to the metal ring by crimping of said ring onto the upper edge of the body of the metal container.

In accordance with one feature of the invention, the flange or shoulder of the resilient joint is crushed against the folded back rim of the ring, when the cover is tightened in the closing position into the groove of said metal ring.

The invention also relates to a metal for manufacturing a metal container with a closing cover such as described above.

To facilitate the manufacture of a metal container in accordance with the invention, the sheath is fixed to the metal ring which is stamped in advance but not yet crimped. The covering of the ring is carried out by threading the peripheral should onto the folded back rim of the ring and by engaging the annular rib of the preformed sheath into the stamped profile of the ring. The resilient sheath which is integral with the ring follows the shape of the stamped profile and can be crimped onto the upper edge of the body of the container in the same manner and using the same apparatus as a ring not provided with a resilient sheath.

The presence of a joint made of a synthetic resilient material in accordance with the invention on the metal ring combines the advantages of a closing metal cover of the American closure or triple tight type with the advantages of a plastic closure, that is, sealing, repeated reuses and long life even in a corrosive medium.

In such a closure, the metal cover has a convex annular profile in its marginal part, which fits into a groove, which has a complementary shape, in a closing ring. In this manner, the cover is held by a double metal-on-metal contact along each of the wings of the groove.

Other features and details of the invention will become apparent from the following detailed description, which refers to the attached drawings which show, as a non-limiting example, one embodiment of a closing cover in accordance with the invention.

BRIEF DESCRIPTION OF THE DRAWINGS

In these drawings:

FIG. 2 is a cross-section of a metal container provided with an interior protective container;

FIG. 4 is a partial cross-section of a metal container with a closure composed of a ring of synthetic material which cooperates with a cover produced either in a synthetic material or in metal, with the ring being fixed to the body of the container by a metal crimping collar.

DETAILED DESCRIPTION OF THE PREFERRED EMBODIMENTS

Figure 1:
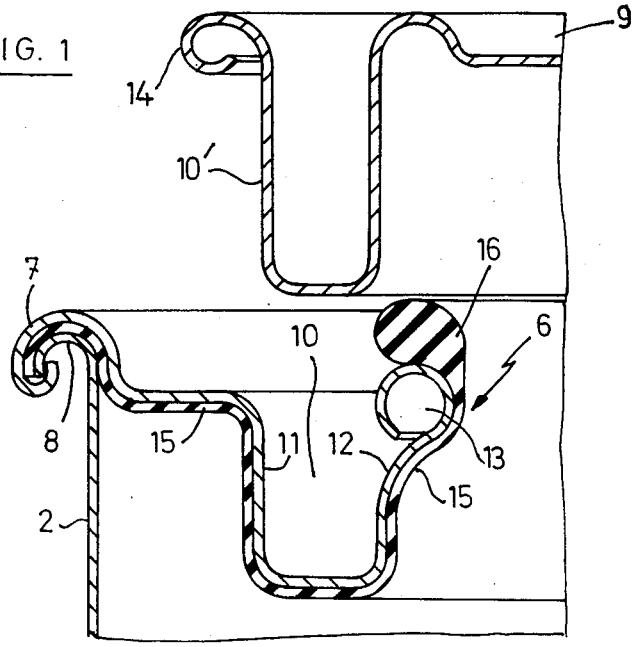
FIG. 1 is a partial cross-section of a metal container with a closing cover in accordance with the invention.

In these drawings, the same reference numerals designate identical or like components.

As illustrated in FIGS. 1 and 2, a metal container, which has the overall designation of reference numeral 1, is formed by a substantially cylindrical body 2, composed of a sleeve of tin-plate crimped along a cylinder generatrix 3 and a circular closing base 4 which is crimped onto the lower edge 5 of said body 2.

The upper part of the metal container is composed of a closure 6.

This closure 6 comprises an interior metal ring 7, crimped onto the upper edge 8 of the body 2' and a metal cover 9. The free side of the ring 7 is stamped in accordance with a predetermined profile.

The ring 7 is stamped so as to have a circumferential groove 10 with two wings 11, 12 intended to enclose a convex profile 10', with a shape corresponding to the metal cover 9.

Figure 3:
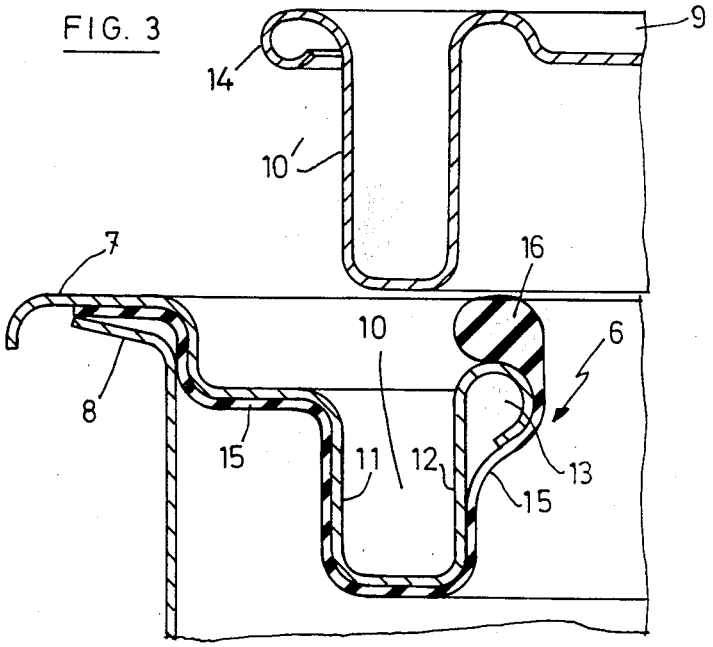
FIG. 3 is a similar view to FIG. 1 of a metal container whose closing ring is provided with a rim which is folded back on the interior side of the container.

The interior wing 12 of the groove 10 of said ring 7 is reinforced by a rim 13. This rim 13 is folded back, either on the side of the groove 10 (FIG. 1) or on the interior side of the container (FIG. 3). This folded back rim 13 is intended to render the profile of the ring 7 more rigid so as to solidly enclose the cover 9.

The cover 9 is generally round. It is composed of sheet metal shaped by press-stamping. The marginal part or rib 10' of the cover 9 has an annular convex profile having a shape which is complementary to that of the groove 10 of the metal ring 7. The peripheral edge of the cover 9 is folded back so as to form a peripheral rim 14.

The ring 7 and the cover 9 are profiled so that, in the closed position of the container, the peripheral rim 14 of the cover 9 is flush with the crimped edge of the ring. There remains between the cover 9 and the closing ring 7 a space into which a the point of a screwdriver (not shown) can be introduced by means of which the cover can be raised and the metal container can be opened.

The convex annular profile 10' of the cover 9 engages into the complementarily shaped groove 10 of the closing ring 7. The sides of the annular profile 10' of the cover 9 are in this manner enclosed by a double metal-on-metal contact along each of the wings of the groove 10 of the closing ring 7.

In accordance with the invention, the interior surface of the ring 7 is covered with a preformed sheath 15 made of a resilient synthetic material. The sheath 15 is provided with an inner peripheral should 16 extending the lip of the interior side of the annular fold of the sheath.

This sheath 15 is mounted on the closing ring 7 after the stamping of the ring but prior to the crimping onto the upper edge of the body 2 of the container. The peripheral shoulder 16 of the sheath 7 rests on the folded back edge 13 of ring 7 and the sheath covers the convex annular portion of the stamped profile of the ring 7.

The ring 7' covered with the resilient sheath 15' is fixed by crimping its exterior periphery onto the upper edge 8 of the body 2 of the metal container 1.

The resilient sheath 15 follows the shape of the stamped profile. In the closed position, the convex annular profile 10' of cover 9 is engaged by the complementarily shaped groove 10 of the closing ring 7.

The annular profile 10' forms a convex rib which fits into said groove 10, so as to be enclosed along its lateral walls by the lateral wings 11, 12 of groove 10. A double metal-on-metal contact is obtained which solidly holds the cover 9 and prevents any inopportune removal of said cover.

In a particular embodiment of the invention, the body and the base of the metal container are covered internally with a lining of a molded synthetic material which is injected or heatformed and which forms an inner container 17 whose upper edge is crimped with the metal ring 7 onto the upper edge 8 of the body 2 of the metal container 1 (FIG. 2).

In a third embodiment, illustrated in FIG. 4, the closure 6 of the metal container is composed of a ring 7 in a synthetic material with interior and exterior wings which are folded back downwardly. The interior wing 12 cooperates with a cover 9 which is produced either in a synthetic material or in metal. The ring 7 is fixed onto the folded back upper rim 8 of the body 2 of the metal container 1 by a metal crimping collar 18.

The invention also relates to a method for manufacturing a metal container provided with a closing cover in accordance with the invention.

After having stamped the metal ring 7 from a preformed resilient sheath 15 of a synthetic material, the sheath is provided, along its interior edge, with a peripheral shoulder 16.

To cover the closing ring 7, prior to crimping (FIG. 3), the preformed sheath 15 is applied against the surface of the ring 7 which faces the interior of the container and the peripheral shoulder 16 of the sheath 15 is folded back over the folded back rim 13 of the ring 7. The assembly formed by the metal ring 7 and said sheath 15 is then crimped onto the upper edge of the body 2 of the metal container.

Finally, in a second embodiment, the crush resistance of a container is increased by surrounding same with a cylindrical metal body 2 and possibly a crimped base 4.

It is obvious that the invention is not strictly limited to the above-described embodiment and that numerous constructional modifications can be made to the closing ring, to the sheath in accordance with the invention and in particular to the means for enclosing the ring, to the composition of the resilient joint, and to the shape of the cover without departing from the framework of the invention which is defined by the following claims.

Thus, the invention is not limited to metal containers formed of a substantially cylindrical container, or it also relates to metal containers of any shape whatever provided with a round closing cover.

What is claimed is:

1. A closure for a metal container (1) composed of a body (2) and a closing base (4) crimped onto a lower edge (5) of said body (2), said closure comprising: an interior ring (7) covered on its lower interior surface with a preformed resilient sheath (15) of synthetic material and crimped onto an upper edge (8) of the body (2), the upper exterior surface of the ring being stamped so as to have a downwardly extending circumferential groove (10) with an interior wing which is reinforced by a rim (13) which is folded back in its extension; and a round cover (9) having both a downwardly extending marginal rib which has a convex annular profile (10') with a complementary shape to that of said groove 10, so as to be tightly retained in said groove, and also a peripheral rim (14); said preformed resilient sheath (15) of synthetic material being ratched on the interior surface of the ring (7), being provided with an internal peripheral shoulder (16) surrounding said folded back rim (13), and being fixed at its exterior periphery by crimping the ring (7) onto the upper edge (18) of the body (2) of the metal container (1).

2. The closure in accordance with claim 1, wherein in the closed position the cover (9) crushes the shoulder (16) of said resilient sheath (15) against the folded back rim (13) of said ring (7).

3. The closure in accordance with claim 1 or 2, characterized in that it is composed of a ring (7) of synthetic material fixed onto the upper edge (18) of the body (2) of the container (1) by a metal crimping collar (18).

4. A method for manufacturing a closure for a metal container (1) in accordance with claim 1 wherein: a metal ring (7) is covered with a resilient annular sealing sheath (15) of a synthetic material, provided with an inner peripheral shoulder (16), by applying the sheath (15) against the interior surface of the ring (7) and by folding back the peripheral shoulder (16) over the folded back rim of the ring (7); and the metal ring, covered with said sheath, is crimped onto the upper edge (8) of the body (2) of the metal container (1).

5. The closure in accordance with claim 1, wherein said interior ring (7) is metal.

* * * * *